US005193293A

United States Patent [19]

Gabalda et al.

[11] Patent Number: 5,193,293

[45] Date of Patent: Mar. 16, 1993

[54] DEVICE FOR THE HEAT TREATMENT OF YARNS IN MOTION

[75] Inventors: Carlos M. Gabalda, Granges Les Valence; Pierre Mirabel, Roanne, both of France

[73] Assignee: Pierre Mirabel, France

[21] Appl. No.: 904,029

[22] Filed: Jun. 25, 1992

[30] Foreign Application Priority Data

Jul. 18, 1991 [FR] France ..... 91 09314
Dec. 20, 1991 [FR] France ..... 91 16208

[51] Int. Cl.[5] ..... F26B 13/00; F26B 19/00

[52] U.S. Cl. ..... 34/68; 34/41; 34/18; 34/155; 432/59; 432/8

[58] Field of Search ..... 34/68, 155, 151, 148, 34/154, 39, 41, 160, 18; 28/219; 432/8, 59, 60; 68/5 R

[56] References Cited

U.S. PATENT DOCUMENTS

| | | | |
|---|---|---|---|
| 2,944,319 | 7/1960 | Crouzet | 28/62 |
| 3,015,872 | 1/1962 | Jones | 28/62 |
| 3,066,471 | 12/1962 | Scragg | 57/34.5 |
| 3,283,414 | 11/1966 | Crouzet | 34/77 |
| 3,606,689 | 9/1971 | Matsuo et al. | 34/155 |
| 3,942,312 | 3/1976 | Venot | 57/34 HS |
| 4,051,650 | 10/1977 | Gleyze et al. | 57/34 HS |
| 4,549,361 | 10/1985 | Brough et al. | 34/155 |
| 4,560,347 | 12/1985 | Rünkel et al. | 34/160 |
| 4,680,872 | 7/1987 | Bauer | 34/41 |

FOREIGN PATENT DOCUMENTS

| | | |
|---|---|---|
| 0332227 | 9/1989 | European Pat. Off. . |
| 1194278 | 11/1959 | France . |
| 1204634 | 1/1960 | France . |
| 1216847 | 5/1960 | France . |
| 1363920 | 5/1964 | France . |
| 960500 | 6/1964 | United Kingdom . |

*Primary Examiner*—Henry A. Bennet
*Assistant Examiner*—Denise L. F. Gromada
*Attorney, Agent, or Firm*—Wall and Roehrig

[57] ABSTRACT

An apparatus for the heat treatment of yarns in motion during various operations such as drawing or texturing includes an insulating enclosure which surrounds a heating block, the combination defining a lengthwise channel through which runs the yarn to be treated. Means for guiding the yarn through the channel is provided to ensure the desired positioning of the yarn inside the channel. The heating block consists of a unit comprising at least two cylindrical sections having different diameters and arranged in the extension of one another. The means for guiding the yarn is positioned along the length of the cylindrical sections so that the yarn may be kept at a constant distance from the surface of the cylinder of smaller diameter, with the result that the yarn passing above the smaller cylinder is heated by radiation. The means for guiding then direct the yarn so that the yarn may come into tangential contact with the surface of the cylinder of larger diameter, with the result that the yarn passing over the surface of the larger cylinder is heated by contact or conduction. Suction means for removing fumes produced by the heat treatment operation associated with a sleeve that closes the outlet end of the device is also provided.

11 Claims, 5 Drawing Sheets

DEVICE FOR THE HEAT TREATMENT OF YARNS IN MOTION

BACKGROUND OF THE INVENTION

1. Field of the Invention

The present invention relates to an improvement made to devices for the heat treatment of yarns in motion in order to impart to the latter certain shrinkage and/or voluminosity and/or elasticity properties.

In the description which follows the conventional expression of "heater" will be employed to denote such a device which, of course, can be employed both for treating continuous, mono- or multifilament yarns and for fibre threads.

2. Description of the Prior Art

In all processes for the treatment of yarns in motion requiring passage through a heater, the chief problem which arises is that of fast heat transmission, it being necessary for the heat to enter uniformly throughout the yarn and in the same manner over the whole length of yarn. In fact, as is known, the temperature of the treatment and its uniformity have a very great influence on the qualities of the yarn produced.

It is well known that the heat treatment varies as a function of the treated substance, the yarn count and its speed of passage inside the heater. Thus, it can be easily seen that the core of a fine yarn would be reached more quickly than that of one of a high count. Similarly, it is known that a yarn cannot be treated above a certain ceiling temperature, or else it degrades. As a result, since this question of heat exchange is very important in the textile field, very many solutions have been envisaged to solve it, these solutions making use of the three great principles of heat exchange, namely convection, radiation and conduction.

Besides this problem of good heat transmission there is also that of maintaining the yarn under a specific tension which is a function of the treatment that is carried out. Thus, for example, in the case of a drawing operation, optionally combined with a texturing operation, the yarn must be kept under a maximum tension whereas, on the other hand, when a yarn shrinkage is to be carried out, the tension must be reduced.

Finally, there is also the problem of the increase in the production rates on a textile machine, which have increased from a few tens of meters per minute about thirty years ago to a thousand meters, or even more at present, these high speeds generating phenomena such as vibrations, which are difficult to control.

Among the solutions proposed to obtain a very good uniformity in heat transmission and also to facilitate the problems of temperature control from one position to another on a machine in order that the whole production should be homogeneous, it has been envisaged for a very long time to carry out heat treatments which could be qualified as being "sequential" by producing heaters over the length of which a number of separate heat treatment zones follow one another. Among these solutions there may be mentioned those forming the subject of French Patent 1,204,634, in which two successive treatments are carried out inside the same heater, one during which the yarn is subjected to a temperature which is considerably higher than that of the normal temperature to which the yarn must be heated, this being done for a period such that the latter is not damaged, this first stage being followed by an equilibrium treatment at a conventional temperature.

Although such a solution is temptingly attractive owing to the fact that it makes it possible to reduce considerably the length of the heaters for a given speed of travel, it requires equipment which is of complex design and difficult to use.

A similar solution is described in French Patent 1,216,847 and its certificate of addition 76861.

In the case of other types of treatment it may be desirable to have a different heat exchange sequence, for example to have a slow and uniform rise in bringing the yarn up to temperature, followed by a more considerable thermal shock, or to combine such stages in a different manner.

SUMMARY OF THE INVENTION

There has now been found, and this is what forms the subject of the present invention, a new type of heater of particularly simple design, which not only makes it possible to carry out such combinations of treatment, but also permits very high running speeds of the yarn inside the heater, the heat exchange being carried out in a very uniform manner, the risks of vibration (and therefore of nonuniformity in the heat treatment) being practically completely eliminated, the location of the yarn inside such a heater being, furthermore, made easier with practically complete elimination of the risk of deterioration of the yarn during this operating stage which is very tricky when carried out at a high production rate.

Furthermore, the new type of heater in accordance with the invention also makes it possible to solve a considerable problem which arises when synthetic yarns are subjected to heat treatments at a high temperature, namely the problem of the removal of the solid deposit which is generally produced at the top of the heating member and which results from the release of vapor which condenses in this region or above it in a zone where the temperature begins to decrease.

Very many solutions have been proposed to solve this problem which has manifested itself for decades, especially during the texturing operations using false twist which have been developed following the advent of chemical fibres.

Among these solutions there may be mentioned that forming the subject of French Patent No. 1,194,278 (corresponding to U.S. Pat. No. 2,994,319) and which consists in providing at the outlet of the heater a removable end fitting which can be easily replaced when it is fouled in order to allow it to be cleaned outside the machine for renewed use.

Another solution, proposed contemporaneously (see especially U.S. Pat. No. 3,066,471), consists in applying suction to the outlet of the heater, thus allowing the fumes produced during the treatment to be removed.

Finally, it has also been proposed, as can be seen especially from French Patent 1,363,920 (which corresponds to U.S. Pat. No. 3,283,414), to apply not only suction to the fumes at the outlet end of the heater, but also an air injection inside the said heater in the direction of movement of the heater. This latter solution, commonly referred to by the expression "suction/blowing", employed in machines as described in U.S. Pat. Nos. 3,942,312 and 4,051,650, is what finally gained the upper hand and is still used today.

Such a solution is not, however, suitable for heaters which enable yarns to be treated at very high speed (more than a thousand meters per minute) and in the case of which the temperature inside the heater can be raised to several hundred degrees, or can even reach more than 1000° C., and this therefore involves particularly draconian treatment conditions.

Now, the new type of heater in accordance with the invention makes it possible, as will be seen in the description which follows, according to one of its preferred embodiments, to produce units allowing the fumes produced during the treatment to be efficaciously removed, avoiding any fouling of the heater during the production.

In general, the new type of heater in accordance with the invention for the heat treatment of a yarn, for example during a drawing/texturing operation, is of the type consisting of an insulating enclosure which surrounds a heater block, with which it defines a "channel" which can be open to the outside, and inside which runs the yarn to be treated, means for guiding the said yarn being provided to ensure its positioning inside the said channel, and it is characterised in that the heater block consists of a unit comprising at least two cylindrical sections having different diameters and arranged in the extension of one another, means for guiding the yarn being provided over the length of the said cylindrical blocks in order that the yarn may be kept at a constant distance from the surface of the cylinder(s) of small diameter, with the result that its rise in temperature is obtained in this or these zone(s) by radiation, and that it may come into contact with the surface(s) of large diameter, the heat transmission being then produced by contact (or conduction).

By virtue of such a design it is therefore possible to produce separate zones for heating by radiation and conduction, zones which can be combined in any way over the length of the heater.

Advantageously, in practice, in accordance with the invention:

means for suction of the fumes produced during the treatment are advantageously provided at the outlet of the heater; in such a case, the said means of suction consist, according to a preferred embodiment in accordance with the invention, of a casing which surrounds the outlet of the heater and which is arranged outside the enclosure, the said casing being connected to a source of suction and having a slit permitting an intake of air from the outside;

the heating member advantageously consists of a single-block unit made of ceramic or stainless steel, the cylindrical zone(s) of small diameter supporting over their length rings provided with guiding members enabling the yarn to be kept at a constant distance from the heating surface, and the zone(s) of large diameter also comprising guiding rings enabling the yarn to come into tangential contact with the surface of this cylindrical part, it being possible for the trajectory of the yarn in this zone to be rectilinear or preferably slightly helical (angle of between zero and 180°);

it may be envisaged to have an orientable outlet ring which makes it possible, during the start-up, to have all the guiding members aligned in relation to one another, and then to make the last guiding member pivot in order to obtain the desired tensioning in the contact zone; such an embodiment makes it optionally possible to associate with the movable guiding member a shutter which can take up two positions, one, when the said orientable or mobile ring is aligned with the other guiding rings during the start-up of the yarn, such that the lengthwise channel is well open to the outside and then, when the said outlet ring is moved, in order that the yarn may form a helix in the contact zone, that the said shutter then covers up the lengthwise channel which is open to the outside, with the result that, in normal operation, a closed treatment conduit is obtained permitting a better homogeneity in the radiation zone, as well as a reduction in the heat losses (power consumed):

according to an alternative form according to which the heater in accordance with the invention is designed to be capable of treating two yarns simultaneously, the guiding rings may be stationary and have bearing grooves for the yarns positioned so as to obtain an immediate and perfect positioning of the yarn over the whole length of the heater;

bringing the actual heating members up to temperature is advantageously obtained by an electrical resistor embedded inside the block, a resistor comprising a built-in thermocouple permitting a perfect temperature control; the heating member can be either embedded and permanently integrated into the block which surrounds it, or optionally may be mounted removably inside the latter;

the dimensions and temperature ranges of such a heater will be adapted as a function of the treatments to be carried out; by way of guidance, in the case of a texturing machine using false twist, the total length may be between 0.3 and 2.5 meters, it being possible for the cylindrical zones of different diameter to be either equal in length or different in length.

However, the invention and the advantages which it provides will be better understood by virtue of the examples of embodiment given below by way of guidance, but without any limitation being implied, and illustrated by the attached diagrams, in which:

BRIEF DESCRIPTION OF THE DRAWINGS

FIGS. 1 and 2 illustrate the heating member of a heater produced in accordance with the invention and the means allowing the yarn to be guided inside the said heater. The structure of the insulating enclosure, the means for bringing the heating member up to temperature and controlling it not being shown for the sake of simplicity.

DETAILED DESCRIPTION OF THE DISCLOSED INVENTION

Figure 1:
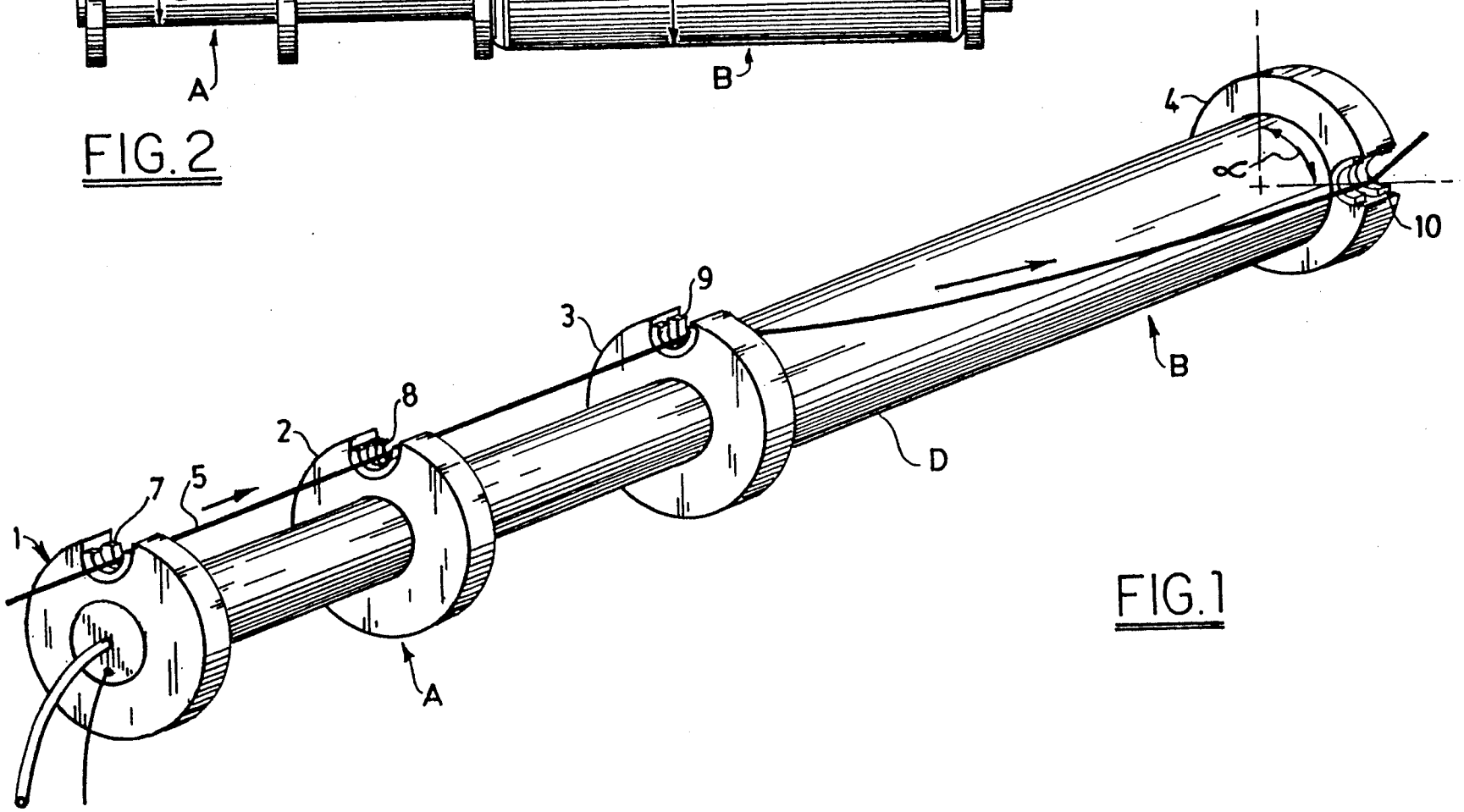
FIGS. 1 and 2 illustrate diagrammatically, in perspective and in elevation respectively, the structure of a heating member for a heater produced in accordance with the invention.
Figure 2:
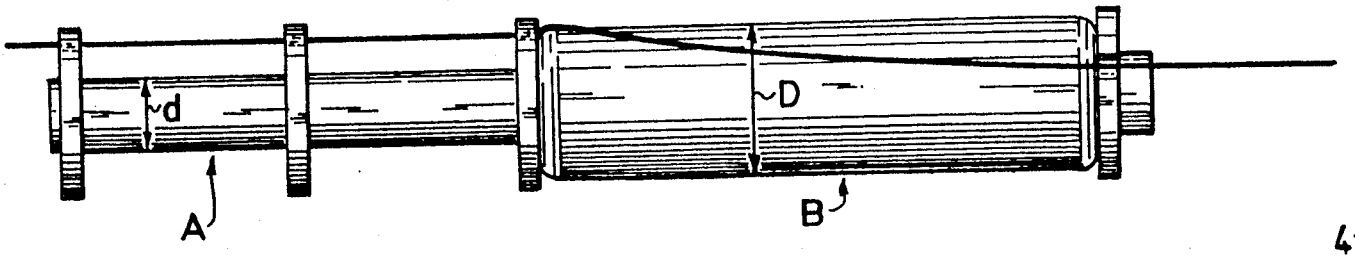

If reference is made to these FIGS. 1 and 2, the heating member of the heater in accordance with the invention consists essentially of a block of overall cylindrical shape comprising two zones A and B of different diameters. In the example illustrated the zones A and B are identical in length but may optionally be different in length. Moreover, the difference in the diameters of the two zones will be generally of the order of a few millimeters. By way of guidance, in the case of a heater of a texturing machine, a diameter difference D−d of the order of eight to ten millimeters is suitable for most textile materials. Such a block is preferably made as a single component, for example by moulding and/or machining a ceramic or a stainless steel. In the case of a heating member based on stainless steel, the large-diameter zone would be preferably surface-treated so as to increase its hardness, for example by plasma treatment, chromium plating etc. Inside the block which is thus produced is embedded a heating resistor preferably comprising a built-in thermocouple member which makes it possible to perform a precise temperature control. Only the connecting members of these heating members have been shown in FIG. 1.

In accordance with the invention, guiding members (1, 2, 3, 4) are mounted on the block thus produced, making it possible, on the one hand, to keep the yarn (5) at a distance from the heating surface of the zone A, which allows a heating by radiation to be obtained in this zone and, on the other hand, to keep the said yarn (5) in contact with the surface of the cylinder in the zone B, thus making it possible to obtain heating by contact or conduction.

In the embodiment illustrated in FIGS. 1 to 4 such guiding members consist of stainless steel rings (1, 2, 3, 4), four in number in the present case, which comprise guiding members (7, 8, 9, 10) defining an outwardly open slit; the guiding members (7, 8, 9, 10) consist, for example, of ceramic or tital eyelets, V- or U-shaped, added inside the rings (7, 8, 9, 10). These guiding eyelets define, with the insulating enclosure which is not shown, a lengthwise "channel" open to the outside, inside which runs the yarn to be treated.

The first three guiding rings (1, 2, 3) are arranged so that the yarn (5) follows a rectilinear trajectory in the zone A, whereas the ring (4), known as the "outlet ring" is either aligned with the abovementioned rings or, alternatively, is slightly offset in order to produce a tensioning of the yarn (5) around the surface of the zone B, as can be seen from FIGS. 1 and 2.

Figure 3:
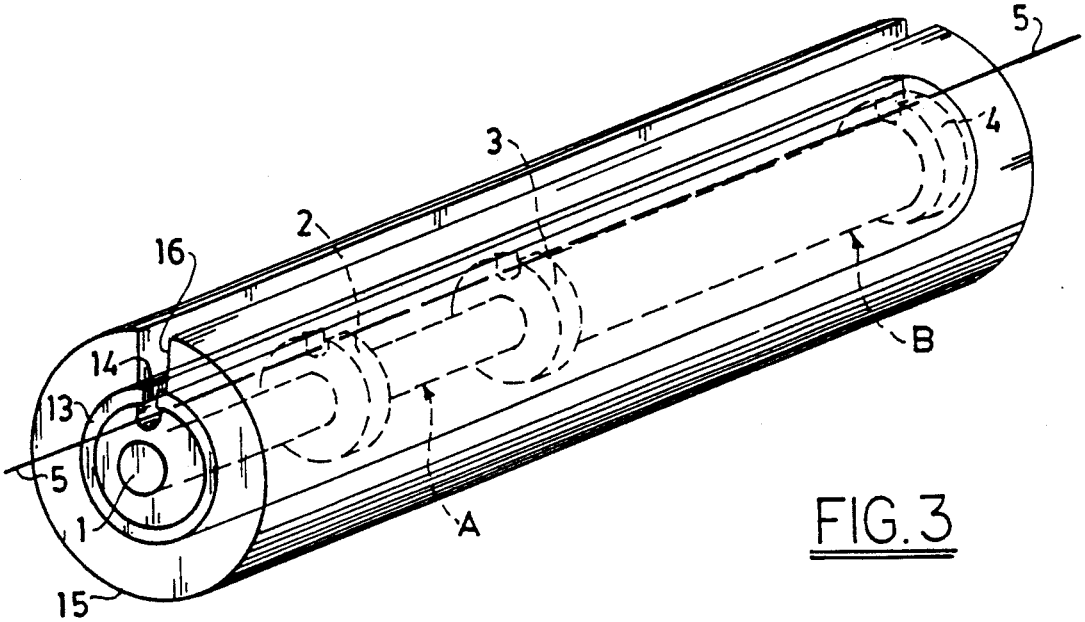
FIGS. 3 and 4 illustrate, diagrammatically and in perspective, a heater produced in accordance with the invention and comprising a movable outlet ring, making it possible to cause the yarn to form a helix in the contact zone and also to shut the lengthwise open yarn passage channel in normal operation.
Figure 4:
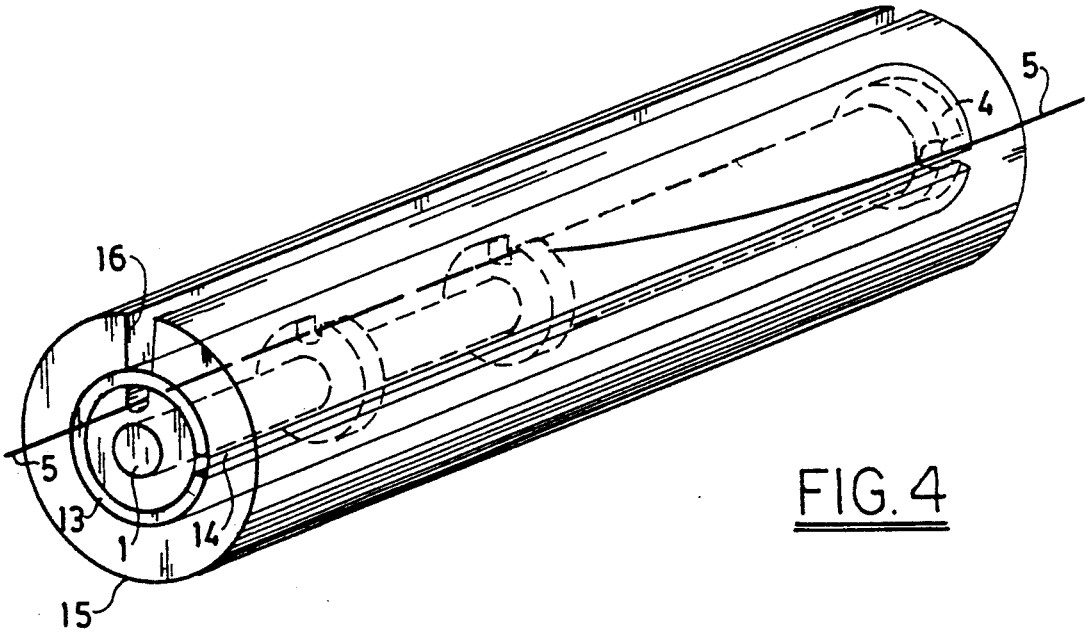

To facilitate the use and to improve the conditions of treatment, the outlet ring (4) can be fitted in a controllable and movable manner, especially to facilitate the start-up operation, the ring (4) being then aligned with the rings (1, 2, 3) and then slightly offset to provide tension in the yarn (5) around the surface of the zone B. Such an embodiment is illustrated by FIGS. 3 and 4. In this embodiment the actual heating member is surrounded by an insulating block (15) made of refractory material and comprising an outwardly open slit (16). The bodywork surrounding this block has not been shown, for the sake of simplicity. During the start-up the four guiding rings (1, 2, 3, 4) are aligned in the way shown in FIG. 3. The outlet ring (4) is associated with a sleeve-shaped shutter (13) made, for example, of stainless steel strip, which is arranged between the insulating block (15) and the actual heating member. This shutter (13) comprises a lengthwise slit (14). By virtue of such a design, during the start-up (FIG. 3) the slit (14) is in register with the slit (16) in the insulating block, and this makes it possible to place the yarn and then, this having been done, for normal production (FIG. 4) it suffices to manoeuvre the outlet ring so as to turn it to bring it into the position shown in this FIG. 4. During the rotation of the outlet ring (4) the sleeve (13) (or shutter) thus covers up the openings of the guiding eyelets, and this makes it possible to form, in normal operation, a closed conduit inside which runs the yarn (5) to be treated.

Figure 5:
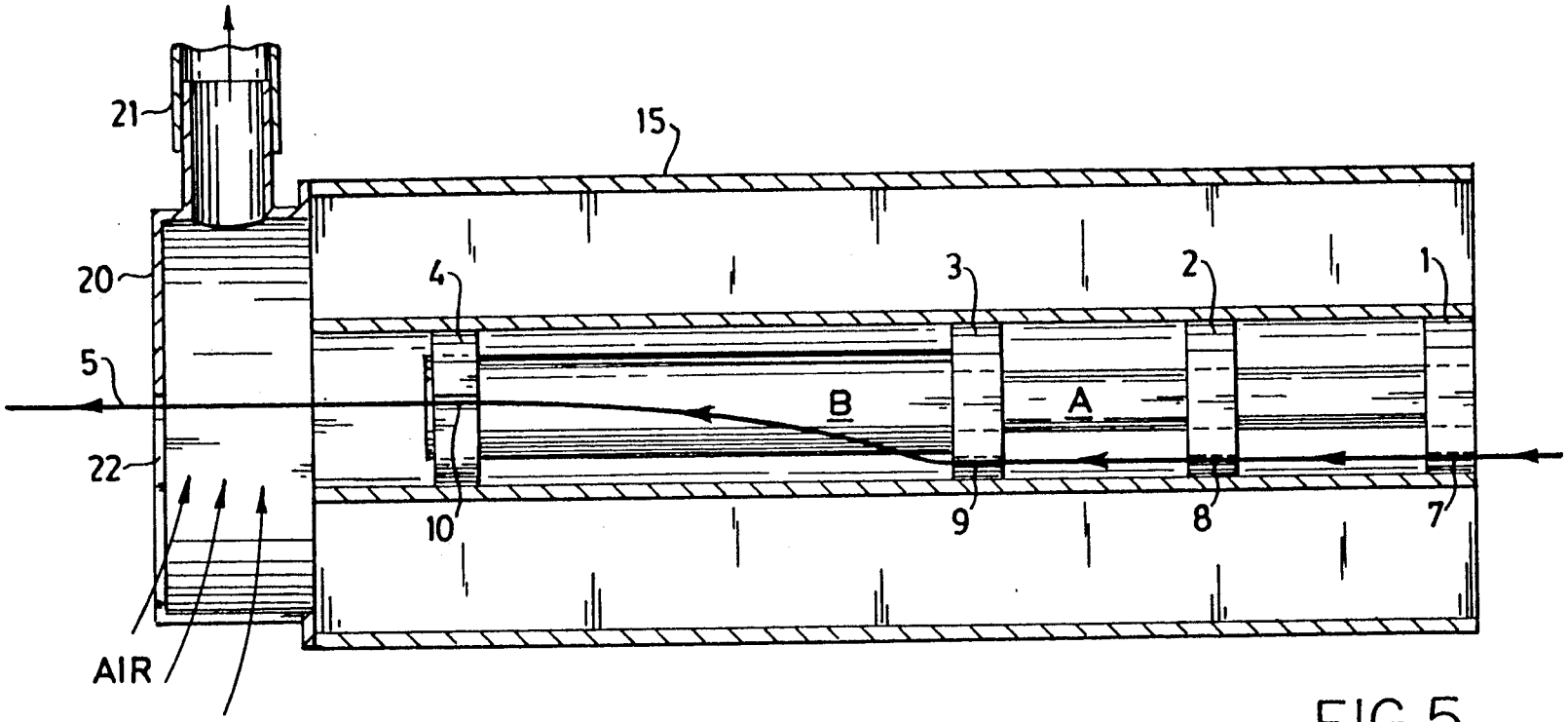
FIGS. 5 and 6 illustrate, diagrammatically, a preferred alternative form of a heater in accordance with the invention, comprising a suction unit making it possible to remove the fumes produced during the treatment of the yarn, FIG. 5 being a view in lengthwise section and FIG. 6 a partial view in perspective, showing the structure of the suction unit of such a heater making it possible to treat two yarns in parallel simultaneously.
Figure 6:
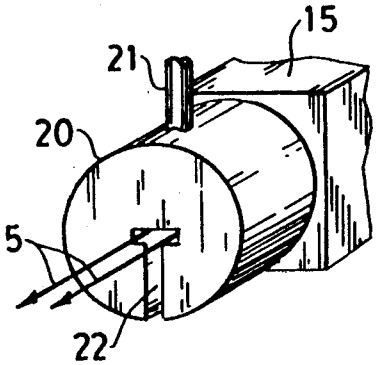

FIGS. 5 and 6 illustrate a heater in accordance with the invention, equipped with a suction system for the fumes and arranged at the outlet of the oven.

If these FIGURES are examined and using the same references as those employed in the case of FIGS. 2 to 4, such a heater is made, as before, of an insulating enclosure (15) which surrounds a heater block of general cylindrical shape and which comprises two zones A, B of different diameters, thus making it possible to have heating by radiation in the zone A and heating by contact in the zone B. As before, rings (1, 2, 3, 4) comprising guiding members (7, 8, 9, 10) are associated with the heating member to ensure the positioning of the yarn (5) inside the heater.

At the outlet of the said heater there is arranged a unit indicated by the general reference (20), in the form of a casing and which is connected by means of a conduit (21) to a source of suction, not shown. Over a part of its height this casing has a slit (22) arranged in alignment with the slit (16) carried by the insulating block (15) and making it possible to insert the yarn during the start-up operation. The upper part of this slit (22), for its part, is positioned so that it is in register with the yarn outlet guiding eyelet (10). As can be seen from FIG. 6, it is thus possible to position two yarns (5) perfectly in parallel to the inside of the heater. Such a unit of particularly simple design enables the fumes and condensates at the outlet of the oven to be eliminated completely, this being done without altering the actual conditions of treatment.

Figure 7:
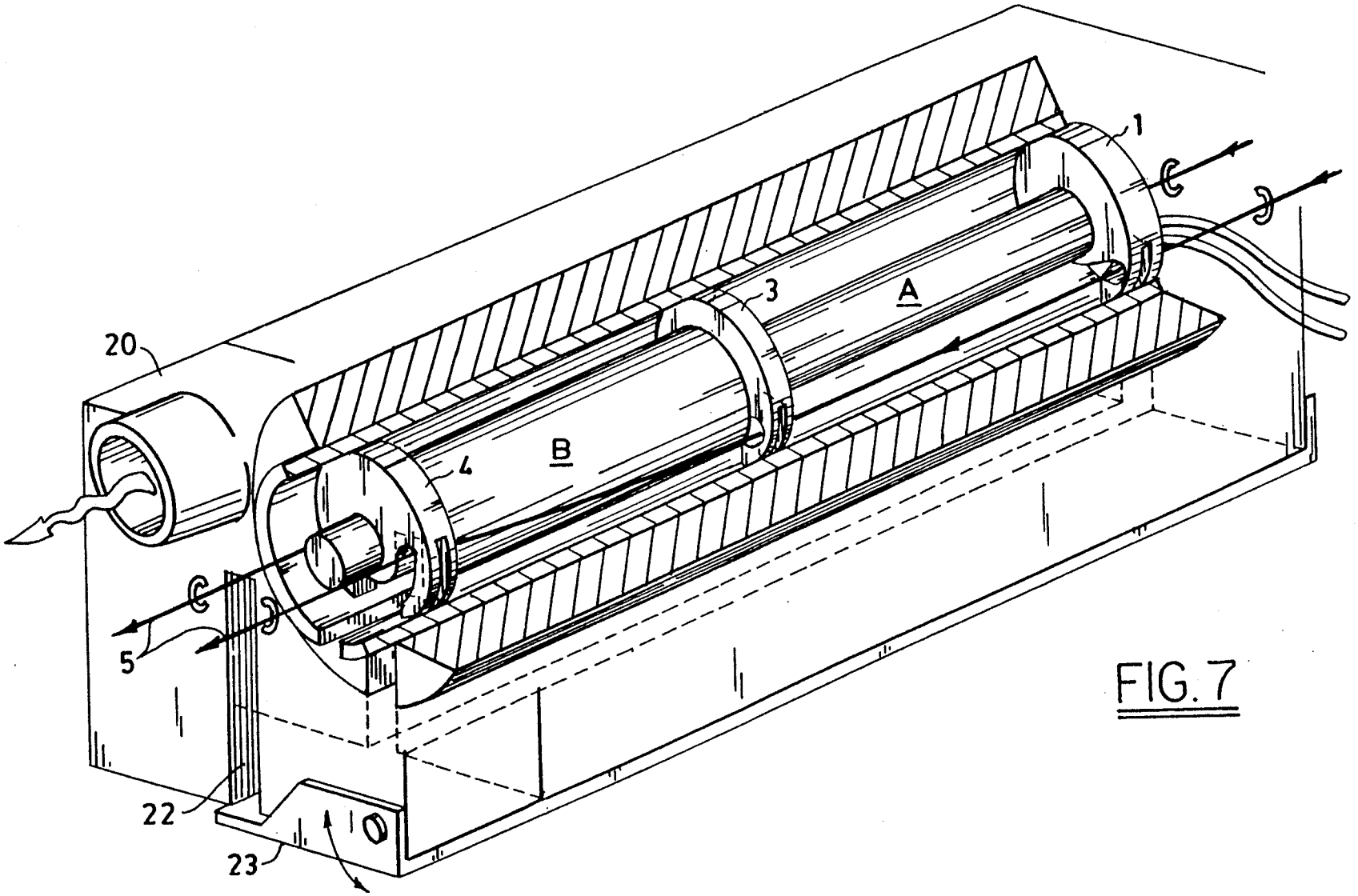
FIG. 7 is an exploded perspective view of a preferred version of heater in accordance with the invention, equipped with a suction unit for the fumes.

FIG. 7 illustrates in perspective, exploded, a heater comparable with that illustrated by FIGS. 5 and 6 and differing from the latter in the fact that it comprises a pivoting shutter flap (23) and that the guiding rings are simply three in number (the rings 1, 3, 4), the intermediate ring (2) provided in the zone A of small diameter being left out. The grooves which make it possible to ensure the positioning of the yarns (5) and provided on the guiding rings are offset in relation to one another, with the result that the two yarns (5) are well kept at a constant distance in the zone A from the heating surface and in contact with the surface of the heating member in the zone B.

Figure 8:
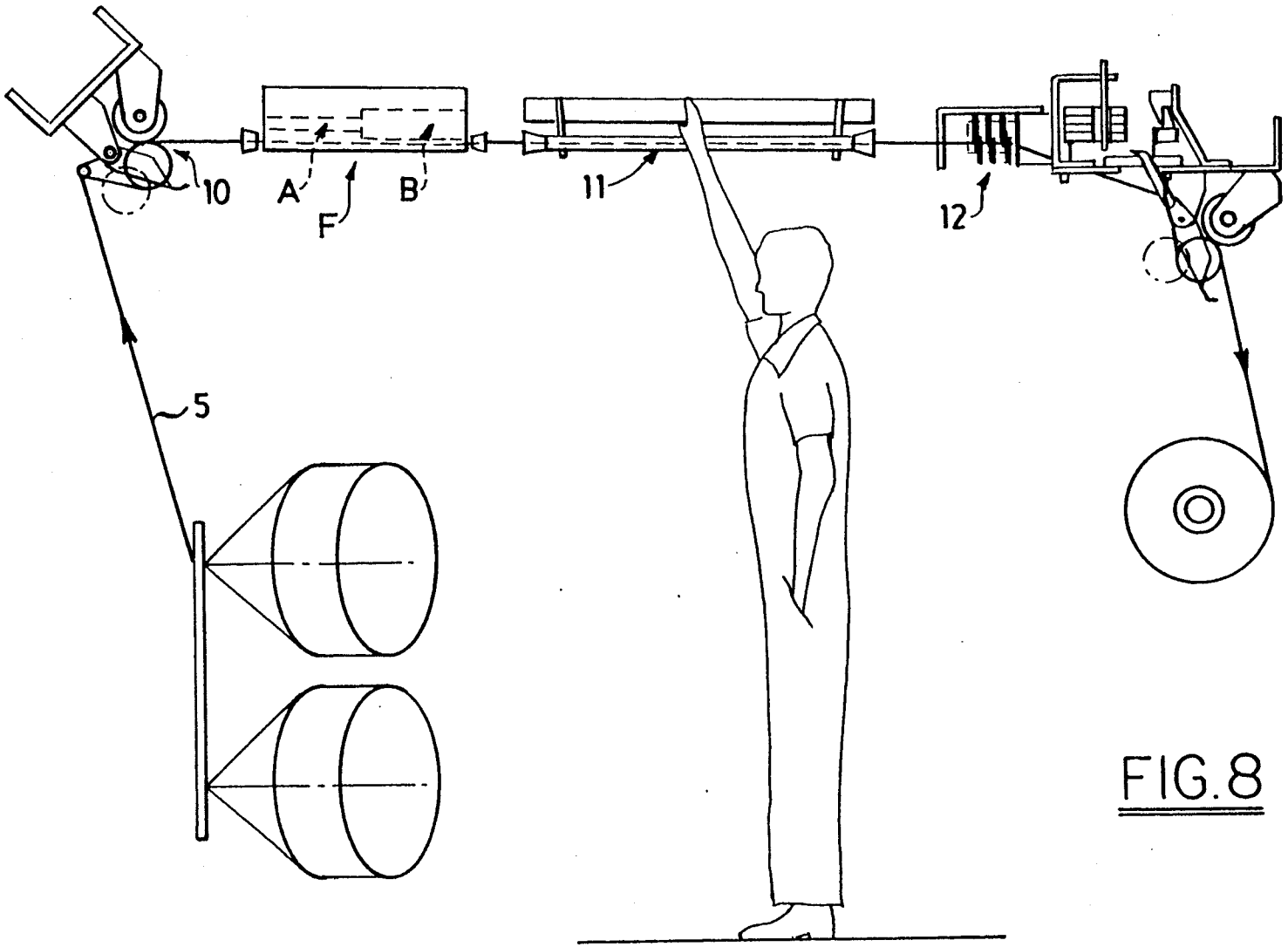
FIG. 8 is an elevation view of a working position of a texturing machine using false twist, equipped with a heater in accordance with the invention.

Such a heater design is particularly suitable for producing texturing machines, especially ones using false twist, which are compact, as illustrated in FIG. 8. In such a machine the heater in accordance with the invention, indicated by the general reference (F), is arranged between a delivery device (10) for the yarn (5) and a cooling zone (11) followed by a false-twist spindle (12). In such a case the heater F is designed so that the yarn may be heated by radiation in the entry zone A, whereas it is heated by conduction in the outlet zone B. In comparison with the previous solutions, it is possible to reduce the length of the heater in the case of a specified rate of treatment, given that in the zone A the yarn is not in contact with the surface of the heating member, it can be raised in temperature very rapidly, the zone B making it possible to promote the heat exchange, also ensuring the guiding and the positioning of the yarn in the zone of heating by conduction. Such a design also avoids vibration phenomena which are detrimental to the yarn (5), above all when working at a very high speed (1,000 or 2,000 m/min).

Other embodiments can also be envisaged, such as, for example, producing the heater from a single block comprising two different zones consisting, for example, of two cylindrical channels having different diameters and arranged in the extension of one another, the yarn being in contact with the surface of the channel of small diameter and being kept at a distance from the surface of the other channel of greater diameter, which thus makes it possible to produce both types of heating, radiation and contact (or conduction) in accordance with the invention. It can also be envisaged to adjoin unit modules following one another, each module enabling one type of heating to be produced.

By way of guidance, such a heater can have a length of between 0.3 and 2.5 meters, a temperature of between 100° C. and 1500° C., a temperature which is naturally a function of the running speed of the yarn and of the treatment.

Naturally, the invention is not limited to the example of embodiment described above, but it covers all the alternative forms thereof produced within the same concept.

We claim:

1. An apparatus for the heat treatment of yarns in motion during various operations which comprises:

a generally cylindrically shaped insulating enclosure having an inlet end and an outlet end, said inlet end for receiving the yarn to be treated;

a heating block including at least two cylindrical sections having different diameters and arranged in the extension of one another, said heating block positioned co-axially within said cylindrically shaped insulating enclosure with the cylinder of smaller diameter proximate to said inlet end thereby defining a lengthwise annular channel within the enclosure; and means for guiding a continuously moving length of yarn through said annular channel from the inlet to the outlet keeping the yarn at a constant distance from the surface of the cylinder of smaller diameter with the yarn passing above the smaller cylinder being heated by radiation and said means for guiding acting to keep the yarn in contact with the surface of the cylinder of larger diameter with the yarn passing over the surface of the larger cylinder being heated by contact or conduction.

2. The apparatus according to claim 1 wherein the trajectory of the yarn passing above the smaller cylinder is rectilinear.

3. The apparatus according to claim 2 wherein the trajectory of the yarn passing over the surface of the larger cylinder is helical by between zero and one hundred eighty degrees.

4. The apparatus according to claim 3 that further comprises suction means for removing fumes produced during the heat treatment, said suction means being positioned at said outlet end of said cylindrically shaped insulating enclosure.

5. The apparatus according to claim 4 wherein said suction means includes a casing surrounding said outlet end, said casing being connected to a source of suction and having a slit permitting an inflow of air from the exterior of said insulating enclosure.

6. The apparatus according to claim 5 wherein said slit allows the yarn to be introduced by sideways movement into said annular channel during the start-up operation and said slit also functions as a guiding member for the yarn at said outlet end.

7. The apparatus according to claim 6 wherein said means for guiding is capable of simultaneously accommodating two continuously moving lengths of yarn through said annular channel from said inlet to said outlet, and said slit is T-shaped when viewed face on, the two lengths of yarn being positioned, in normal operation, at the end of the arms of said T-shaped slit.

8. The apparatus according to claim 7 wherein each cylinder of said heating block consists of a single unitary ceramic or stainless steel segment and said means for guiding includes a plurality of rings secured to a plurality of guiding members, said guiding members being positioned along the length of the smaller cylinder so that the yarn is kept at a constant distance from the heating surface of the smaller cylinder and positioned at the inlet and outlet ends of the larger cylinder so that the yarn is kept in tangential contact with the heating surface of the larger cylinder.

9. The apparatus according to claim 8 wherein the guiding member positioned at the outlet end of the larger cylinder is rotatably attached thereto so that during the start-up operation said plurality of rings supporting the yarn can be aligned co-linearly and then said outlet guiding member can be rotated to position the yarn with a desired tension in tangential contact with the heating surface of the larger cylinder.

10. The apparatus according to claim 9 wherein said outlet guiding member is associated with a sleeve, said sleeve being capable of closing the opened outlet end of said insulating enclosure so as to form a closed conduit inside which the yarn runs in normal operation.

11. The apparatus according to claim 10 wherein heating of the cylinders is obtained by an electrical resistor positioned within said heating block, said resistor including a built-in thermocouple for precise temperature control.

* * * * *

UNITED STATES PATENT AND TRADEMARK OFFICE

CERTIFICATE OF CORRECTION

PATENT NO. : 5,193,293

DATED : March 16, 1993

INVENTOR(S) : Carlos M. Gabalda

It is certified that error appears in the above—identified patent and that said Letters Patent is hereby corrected as shown below:

On the cover page after [73] Assignee: Please delete Pierre Mirabel, France and insert ICBT Roanne, France.

Signed and Sealed this

Twenty-ninth Day of March, 1994

*Attest:*

Bruce Lehman

BRUCE LEHMAN

*Attesting Officer*

*Commissioner of Patents and Trademarks*